United States Patent [19]

Lowe

[11] 4,054,208

[45] Oct. 18, 1977

[54] DOUBLE WALLED INSULATED MEDICINAL TABLET CONTAINER

[76] Inventor: Fred H. Lowe, 4535 Manning Lane, Dallas, Tex. 75226

[21] Appl. No.: 755,108

[22] Filed: Dec. 28, 1976

Related U.S. Application Data

[63] Continuation of Ser. No. 622,926, Oct. 16, 1975, abandoned.

[51] Int. Cl.[2] ..... B65D 13/02; B65D 85/56

[52] U.S. Cl. ..... 206/537; 215/13 R

[58] Field of Search ..... 206/212, 306, 535, 536, 206/537, 37 R; 215/13 R; 220/9 R, 9 L, 17

[56] References Cited

U.S. PATENT DOCUMENTS

| | | | |
|---|---|---|---|
| 415,428 | 11/1889 | Wolf | 215/13 R |
| 957,809 | 5/1910 | Steel | 215/13 R |
| 1,095,854 | 5/1914 | Gray | 206/212 |
| 1,199,772 | 10/1916 | Engel | 215/13 R |
| 2,076,549 | 4/1937 | Conner | 215/13 R X |
| 2,725,733 | 12/1955 | Davis | 215/13 R |
| 2,772,772 | 12/1956 | Taylor | 206/537 |
| 2,832,493 | 4/1958 | Murphy | 215/13 R |

FOREIGN PATENT DOCUMENTS

| | | | |
|---|---|---|---|
| 93,836 | 12/1938 | Sweden | 206/535 |

*Primary Examiner*—Stephen Marcus

*Attorney, Agent, or Firm*—Howard E. Moore; Gerald G. Crutsinger

[57] ABSTRACT

An improved medicinal tablet, capsule or pill container comprising an outer tube sealed at one end having a cap threadedly secured thereto with an inner tube of translucent material such as amber colored plastic or glass having an inner closed end disposed within the outer tube. A spacer positioned about the closed end of the inner tube between the inner tube and the outer tube forms chambers of air between the inner and outer tube to insulate the inner tube from transmission of heat therethrough.

1 Claim, 3 Drawing Figures

DOUBLE WALLED INSULATED MEDICINAL TABLET CONTAINER

This is a continuation of application Ser. No. 622,926, filed Oct. 16, 1975, now abandoned.

BACKGROUND OF THE INVENTION

It is often necessary for certain patients to carry supplies of medicinal tablets on the person to be readily available if the need should arise for immediate medication. An example of this is a cardiac patent who must carry tablets of nitroglycerin with him at all times in case of an emergency.

Problems arise in that certain medicinal tablets such as nitroglycerin are sensitive to light, especially ultraviolet light rays and heat. When exposed to these elements the tablets will decompose rapidly and lose their effectiveness.

Heretofore pill holders which have been used to carry supplies of medicinal tablets have resulted in large amounts of wasteage of the tablets in that they do not protect tablets from the heat of the body when they are kept next to the body, such as in a shirt pocket or the like. When the tablets are kept in a clear vial so that user may determine the extent of his supply light deteriorates the tablets.

SUMMARY

An improved container particularly adaptable for storing medicinal tablets such as nitroglycerin having an amber tinted glass vial encased by an outer tube preferably made of transparent plastic such as Lucite, an acrylic resin, a product of E. I. DuPont de Nemours and Company. The outer opening of said tubes are sealed together with a spacer about the closed end of the amber colored vial, forming a chamber of air between the sealed ends of the tubes and spacer and amber tinted vial and outer Lucite case to insulate the inner vial. The Lucite case permits observation of the supply of tablets left in the amber vial while the amber tinted vial, although sufficiently translucent to viewing the contents filters out the deteriorating ultra-violet light rays before contacting the tablets therein. The Lucite case has a threaded cap which permits easy access to the tablets inside, and seals them from exposure to air.

A primary object of the invention is to provide a small readily accessible medicinal tablet or pill container which may be conveniently attached to clothing on the body or placed in a purse which will protect medicinal tablets which are readily harmed by heat, light or moisture.

A further object of the invention is to provide a medicinal tablet or pill container which when attached to clothing on the body will protect the contents against body heat.

A further object of the invention is to provide such a container which is readily sealable from the air to prevent decomposition of the tablets inside by moisture in the air.

A further object of the invention is to provide such a container which prevents tablets therein from being crushed when they are stored in a purse or on the body.

Other and further objects of the invention will become apparent upon reading the detailed description and inspection of drawings annexed hereto.

DESCRIPTION OF THE DRAWINGS

Drawings of a preferred embodiment are annexed hereto so that the invention may be better and more fully understood; in which.

Numeral references are used to designate parts shown in the drawing and like numerals are used to designate like parts throughout the various figures of the drawings.

DESCRIPTION OF A PREFERRED EMBODIMENT

Figure 1:
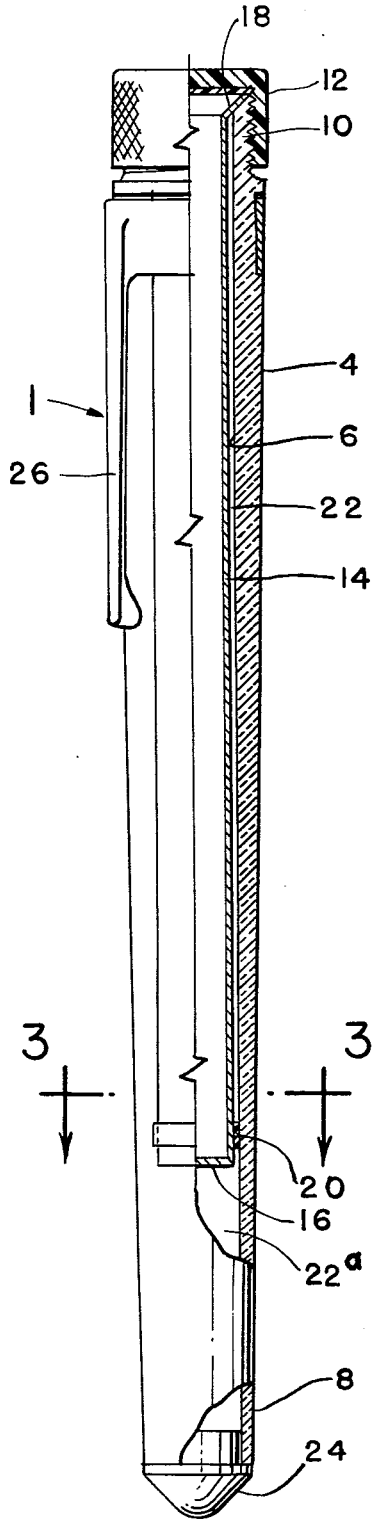
FIG. 1 is an elevational view partially sectionalized to better illustrate the pill holder.
Figure 2:
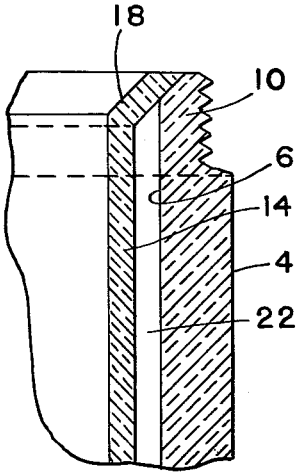
FIG. 2 is an enlarged sectionalized view of the seal between the outer and inner tubes.
Figure 3:
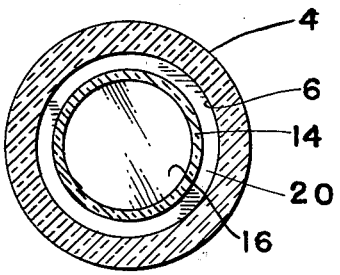
FIG. 3 is a cross-sectional view taken along line 3—3 of FIG. 1.

The numeral 1 generally designates the pill holder illustrated in FIGS. 1–3 and is comprised of a hollow outer tube 4 composed of a transparent material such as glass, or plastic such as Lucite.

The hollow outer tube 4 has a first closed end 8 which is sealed by an end cap 24 which may be formed by dipping same in a liquid plastic material and allowing it to solidify thereon in sealing engagement therewith to seal off the end.

The open end 10 of hollow tube 4 has a cap 12 threadedly secured thereto to seal the end of outer tube 4 from air. The hollow outer tube 4 encases a second inner hollow tube 14 constructed of light shielding material such as translucent amber glass or plastic to prevent transmission of ultra-violet light rays therethrough. End 16 of the inner tube 14 is sealed or closed off by melting or forming the glass into a substantially flat bottom configuration.

The other end 18 of the inner tube 14 is flared to form a seal with the open end 10 of hollow tube 4, as best illustrated in FIG. 2 of the drawing. Seal means such as a coat of adhesive material, such as latex, is placed about the outer end 18 of the inner tube 14 before it is placed inside the outer tube 4. A hot mandrel having a diameter slightly larger than the inside diameter of the inner tube 14 is positioned in end 18 and forced thereinto to expand the glass tube 14 outwardly into sealing engagement with the upper end of tube 14, causing the adhesive to set and form a seal between the outer tube 4 and the inner tube 14.

The inner tube 14 is spaced from the bore 6 of hollow tube 4 by a spacer 20 adjacent end 16 of tube 14. The spacer 20 is preferably made of resilient material and is secured about the end 16 prior to installation of the inner tube 14 and fits tightly between inner tube 14 and outer tube 4, forming chambers 22 and **22*a* of air between the spacer 20 and the sealed end 18 of tubes 4 and 14 and between the spacer 20 and the closed end 8 of outer tube 4 to insulate the medicinal tablets which may be placed inside the inner tube 14** from heat.

From the foregoing it should be readily apparent that the insulation spaces or chambers 22 and **22*a* protect the material stored therein from the heat of the body when the tube is placed in a shirt pocket or the like. It should also be readily apparent that by glancing at the tube with a transparent outer case and a translucent inner amber tinted case the amount of the supply in vial 1 may be determined at a glance without removal of the cap 12.**

In assemblying the container 1 the spacer 20 is forced into outer tube 4, forcing air out through the open end thereof after which the outer end 18 is sealed with end 10 of outer tube 4 and a seal is formed over end 8 of outer tube 4 by end cap 24. This permits the container to be assembled with sealed insulation spaces 22 and 22*a* between outer tube 4 and inner tube 14 to protect the tablets disposed in inner tube 14.

A clip 26 is secured to end 10 of the outer tube 4 to provide a means to secure the container 1 to a shirt pocket if desired.

It should be readily apparent that the container may be used to store and carry any kind of medicinal tablets or pills and is particularly adapted to package and carry perishable medicinal tablets such as nitroglycerin which are suspectible to decomposition when exposed to heat, light and moisture. The amber tinted inner tube 14 provides protection from the ultra-violet rays of light which tend to decompose drugs such as nitroglycerin or the like and the insulation chambers 22 and 22*a* prevent moisture and heat from the body from decomposing the tablets as well.

It should be readily apparent from the foregoing that readily accessible method of carrying small supplies of drugs on the person which allows easy determination of the amount of supply left without exposing the drugs to air, light or heat and moisture has been provided by my invention.

Having heretofore described my invention, I claim:

1. A pocket size container for carrying nitroglycerin tablets on the person comprising: a narrow hollow elongated cylindrical outer tube, said outer tube being composed of transparent material, a narrow hollow cylindrical shaped inner tube within the outer tube of smaller diameter than the outer tube forming an annular space therebetween, said inner tube having a closed inner end spaced from the end of the outer tube to form an air space between the ends of the inner and outer tubes and said inner tube being adapted to carry a plurality of medicinal tablets in stacked relationship, said inner tube being composed of amber translucent material to shield the contents from ultraviolet light; an annular resilient sealing ring secured about the inner tube within the annular space adjacent the closed end of said inner tube to space and seal the inner tube from the inside of the outer tube to form an annular cavity of air therebetween, said cavity extending along the length of said inner tube to the upper end of the outer tube; the open end of said inner tube being flared outwardly over the end of said outer tube to form a seal therebetween to close and seal the annular cavity of air; and a cap secured over the open end of said outer tube.

* * * * *